United States Patent [19]

Oelsch et al.

[11] Patent Number: 4,580,022

[45] Date of Patent: Apr. 1, 1986

[54] KEYBOARD KEY WITH MEANS FOR SUPPORTING LARGE KEY SURFACE

[75] Inventors: Jurgen Oelsch, Salz; Bertold Stürmer, Bad Neustadt, both of Fed. Rep. of Germany

[73] Assignee: Preh Elektrofeinmechanische Werke, Jakob Preh, Nachf. GmbH & Company, Bad Neustadt, Fed. Rep. of Germany

[21] Appl. No.: 641,450

[22] Filed: Aug. 16, 1984

[30] Foreign Application Priority Data

Aug. 17, 1983 [DE] Fed. Rep. of Germany ..... 3329698

[51] Int. Cl.[4] ..... H01H 13/02

[52] U.S. Cl. ..... 200/340

[58] Field of Search ..... 200/340

[56] References Cited

U.S. PATENT DOCUMENTS

| | | | |
|---|---|---|---|
| 3,916,150 | 10/1975 | Abernethy et al. | 200/340 |
| 4,433,225 | 2/1984 | Cowles | 200/340 |
| 4,453,063 | 6/1984 | Wanatowicz, Jr. et al. | 200/340 |

*Primary Examiner*—Stephen Marcus
*Assistant Examiner*—Renee S. Luebke
*Attorney, Agent, or Firm*—Woodcock Washburn Kurtz Mackiewicz & Norris

[57] ABSTRACT

An improved key for typing keyboards or other terminal keyboards, which is substantially larger than the other keys and large compared with the contact to be actuated. In order to avoid tilting during out-of-center pressing, two shears are provided as a guiding means between the mobile and the immobile key parts. The shears are comprised of two frame parts pivoted about axes which are held aligned flush with each other. The shear arms provide four support points at their top free ends which enclose a rectangular surface which is practically congruent with the touch surface.

17 Claims, 9 Drawing Figures

KEYBOARD KEY WITH MEANS FOR SUPPORTING LARGE KEY SURFACE

BACKGROUND OF THE INVENTION

1. Field of the Invention

The present invention pertains to a keyboard key with a touch surface on a mobile part of the key, which surface is large compared with an electrical contact to be actuated, and with a guiding means which guides the mobile part of the key relative to an immobile part of the key, wherein the guiding means is linked with the mobile part on the one hand, and with the immobile part of the key, on the other hand, and the guiding means transmits a touch force exercised on an edge zone of the touch surface to an opposite edge zone of the mobile part of the key.

2. Description of the Prior Art

The general type of key with respect to which this invention provides an improvement is, for example, the "space" key of a typewriter keyboard. In such a key, which is long but narrow, the guiding means is formed by a swivel bow which is linked to both ends of the key. When pressed at one end of the key, it carries the other end of the key, so that the switching of the electrical contact is practically independent of the point at which the key is pressed. In addition to this type of key, large keys are also often provided in the case of typewriter keyboards as well as input and output keyboards of terminals, which large keys cover a large surface which is several times the size of the prevailing key size. It must be ensured in the case of such keys that when the key is pressed the corresponding switching contact is always actuated in the same manner, regardless of which part of the key is being pressed. In addition, there should be no tendency to jam. Keys of the general type described above often have no return spring members of their own. They are often brought into their home position by a resetting spring which also replaces the corresponding electrical contact. For example, rubber membranes are provided for this purpose. In the case of large-area keys of this type it must be ensured that the key returns to its home position safely, even if no resetting spring is provided and the resetting force of the contact assembly is weak and does not act in a central area of the key.

SUMMARY OF THE INVENTION

The object of the present invention is to provide a large surface key in which there is no risk of tilting or jamming either during pressing or resetting, particularly where the key is large in terms of length and width compared with the contact to be actuated or the other keys of a keyboard.

According to the present invention the above object is solved in such a way that a guiding means is formed by two shears where the two arms of each shear are pivoted about an axis, the two axes being aligned flush with each other, and wherein the top free ends of the four shear arms provide four support points for the mobile part of the key in the direction of pressing and are mobile across this direction. The four support points enclose a rectangular area which is practically congruent with the pressing surface, while the lower free ends of the four shear arms are held at the immobile part of the key in the direction of pressing, and are mobile across this direction.

The guiding means formed by the double shears ensures that when the key is being pushed out of center, the other zones are carried in parallel, so that the key does not consequently tilt. The switching characteristic of the contact is not influenced by the guiding means.

The novel guiding means of this invention also ensures that the resetting force originating from the electrical contact is transmitted to the support points located at a certain distance, so that the key returns to its home position without any major losses due to friction, and is not jammed in the process.

Another advantage of the key according to the present invention is the fact that the tolerances of the guiding means have no substantial influence on the movement characteristics, so that a relatively large play can be permitted between the parts.

A yet further advantage of the invention is that the double shears have a very small overall height, so that the touch surface of the key according to the present invention can have the same height as the other keys, and can also be arranged on the same contact plate as the other keys.

In a preferred embodiment of the present invention the arms of the shears are combined in pairs into frames. The axis of one of the shears is encompassed by fingers of the other shear. This leads to a simple, continguous structure of the two shears.

Other advantageous embodiments of the present invention appear from the following description of an embodiment, and as set forth in the claims.

DESCRIPTION OF THE PREFERRED EMBODIMENTS

Figure 1:
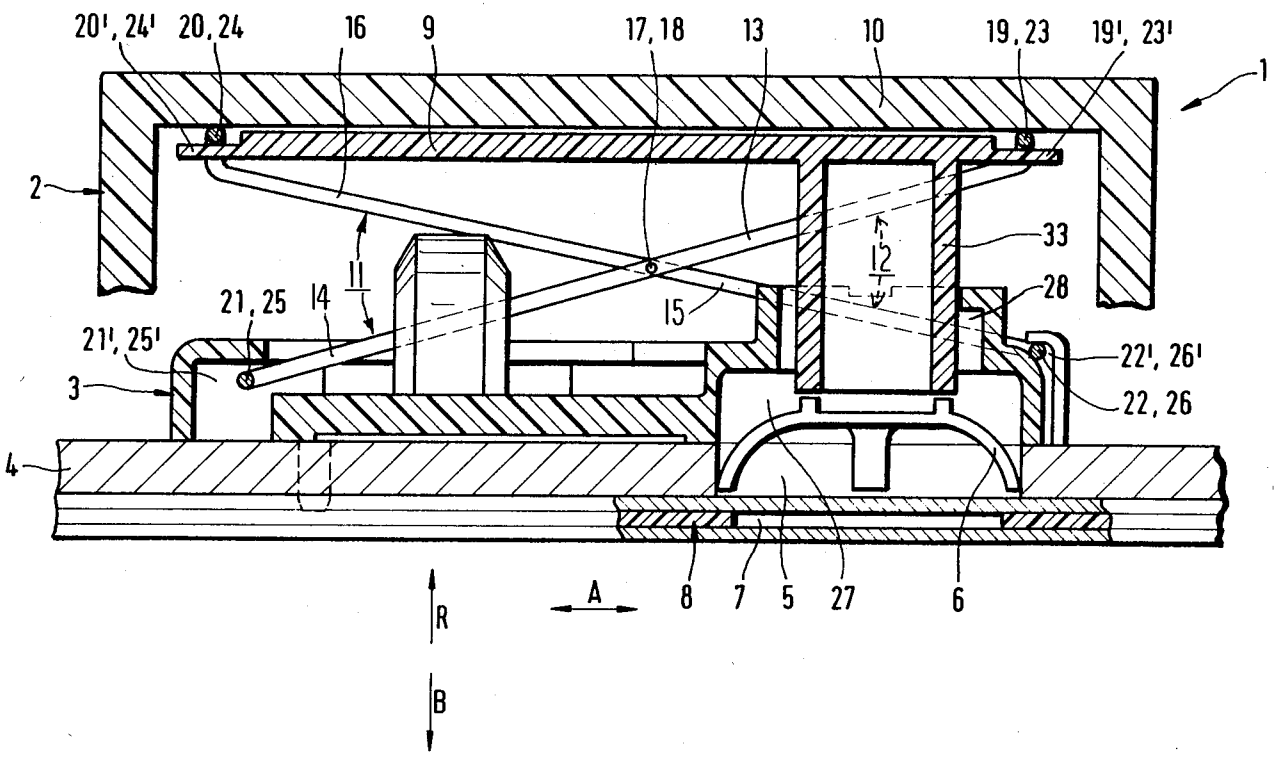
FIG. 1 shows a schematic side view of a keyboard key according to the invention.
Figure 2:
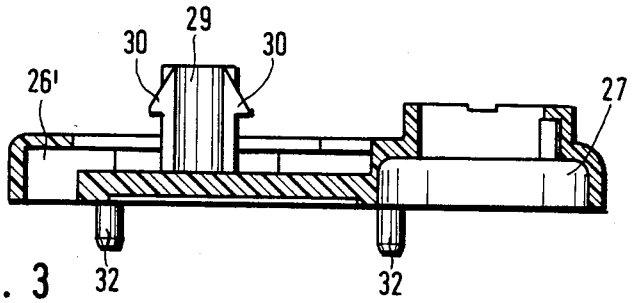
FIG. 2 shows a section of the immobile part of the key of FIG. 1, along the line II—II shown in FIG. 3.

Referring to FIG. 1, a key 1 is shown having a mobile key part 2 and an immobile key part 3, the immobile part being placed on a mounting plate 4 of a keyboard. The mounting plate 4 has holes 5 in it in which elastic switching bodies 6 are arranged. Under the holes 5 are arranged switch chambers 7 of a printed-circuit film 8. The electrically conducting linings which come into contact with each other upon actuation of one of the switching bodies 6 are provided on opposite sides of the switch chamber 7. The mobile key part 2 consists of a support 9 and a key top 10 placed on it. As is apparent from FIGS. 1–6, the touch surface of the key top 10 is large compared with the elastic switch body 6. The switch bodies 6 are distributed on the mounting plate 4 in such a way that the prevailing quadratic keys provided on the keyboard are located close to each other.

A guiding means is provided between the immobile key part 3 and the support 9, which guiding means comprises two frame parts which form shears 11 and 12. A first frame part consists of arms 13 and 14, and a second part has arms 15 and 16. The shear 11 has two arms, 14 and 16, which are connected to pivot about a pin at axis 17. Likewise, the arms 13 and 15 of the shear 12 are connected to pivot around an axis 18. The axes 17 and 18 are flush with each other and are maintained aligned. Pins 19 and 23 are provided at the free end of arm 13 and pins 21 and 25 are provided at the free end of arm 14, respectively. Pins 20, 24 and 22, 26 respectively are provided likewise at the ends of arms 15 and 16.

Guide pockets 21', 25', 22' and 26' are provided on the immobile key part 3 for receiving the pins 21, 22, 25 and 26. These pockets permit a displacement of the pins in the direction A, but not in the operating direction B or in the resetting position R.

Figure 3:
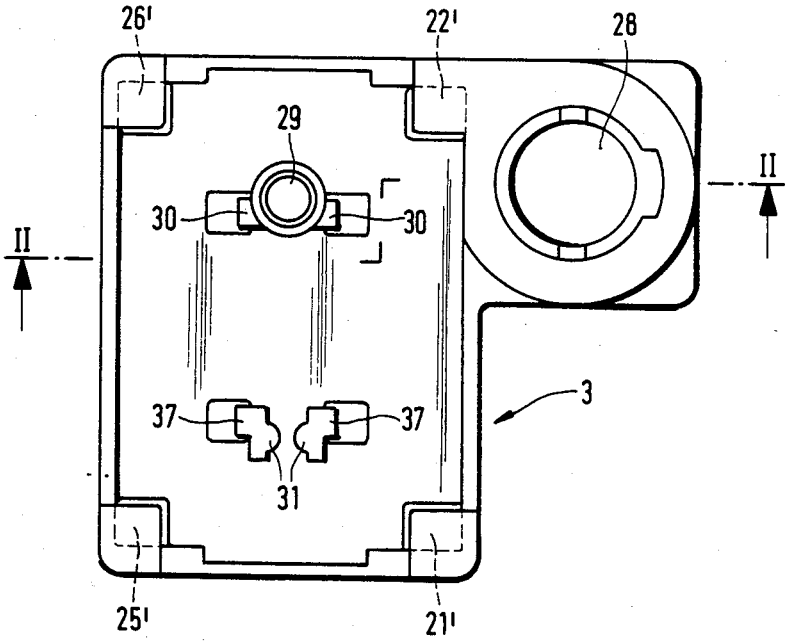
FIG. 3 is a top view of the immobile part of the key of this invention.

A recess 27 (FIG. 2) is provided on the immobile key part 3 for receiving the switching body 6. The recess 27 is joined by an opening 28 (FIGS. 1 and 3). The key part 3 has a guide sleeve 29 which is provided with stops 30 on the outside. In addition, guide beads 31 are arranged on key part 3, as seen in FIG. 3. Pins 32 serve for fastening to the mounting plate 4.

Figure 4:
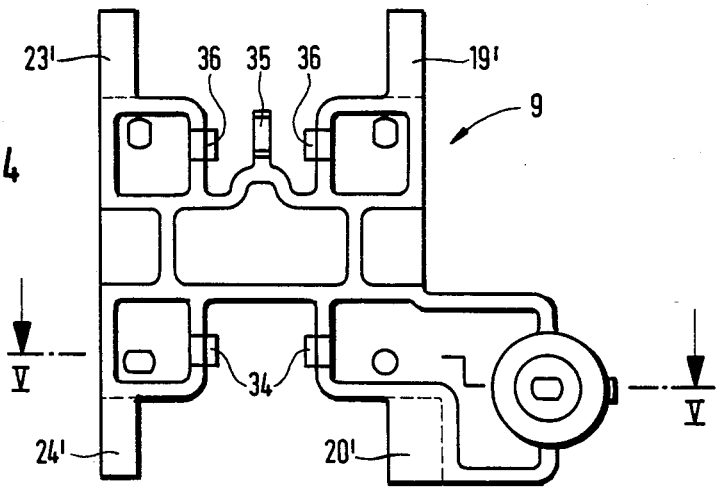
FIG. 4 is a bottom view of the support of the mobile part of the key of this invention.
Figure 5:
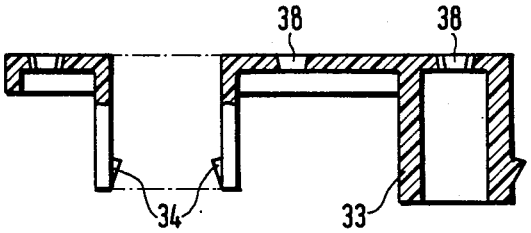
FIG. 5 is a section of the support along the line V—V shown in FIG. 4.

The support 9 has support tongues 19', 20', 23' and 24' for the pins 19, 20 as well as 23 and 24. A switching slide 33 which fits through the opening 28 and reaches into the recess 27 is provided at the support 9. The support 9 has catch tongues 34 (FIGS. 4, 5) which correspond to the stops 30. Together with them they limit the travel of support 9 relative to the key part 3. The support 9 also has a bead 35 which catches between the guide beads 31. With further catch tongues 36 next to the bead 35 and corresponding stops 37 (FIG. 3) outside on the guide beads 31 the travel is limited additionally to the catch assembly 30, 34. The support 9 also has openings 38 for fastening the key top 10, as seen in FIGS. 4 and 5.

Figure 7:
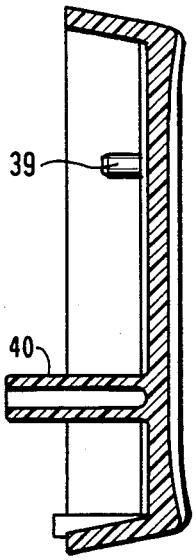
FIG. 7 is a section along the line VII—VII shown in FIG. 6.
Figure 6:
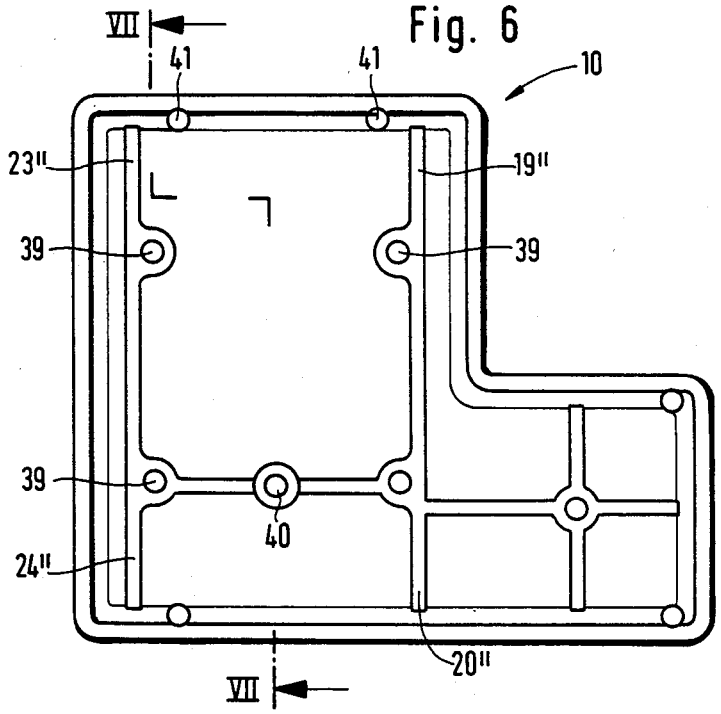
FIG. 6 is a bottom view of the key top of the mobile part of the key.

Pins 39 (FIGS. 6,7) are molded on the lower side of the key top 10, which can be pushed into the openings 38 in a form-fit manner. The key top has a bolt 40 which reaches into the guide sleeve 29 through the support 9. In addition, lugs 41 which hit the outer edge of the immobile key part 3 upon pressing the key 1, are arranged on the outer edge of the key top 10. The pins 19, 20, 23 and 24 are held between the beads 19'', 20'', 23'' and 24'' and the support tongues 19', 20', 23' 24' in such a way that they can be moved in transverse direction A, but not in the operating direction B or in resetting direction R. As can be seen in FIG. 6, these four support points of the pins 19, 20, 23, and 24 enclose a rectangular area which is practically congruent with the touch surface (base of the key top 10). The rectangle defined by the support points is congruent with the larger part of the L-shaped touch surface of the key top 10. The rectangle which is defined by the support points of the lower pins 21, 22, 25 and 26, which is defined by the guide pockets 21', 22', 25' and 26' is exactly of the same size as the rectangle which is defined by the above-mentioned support pins.

Figure 9:
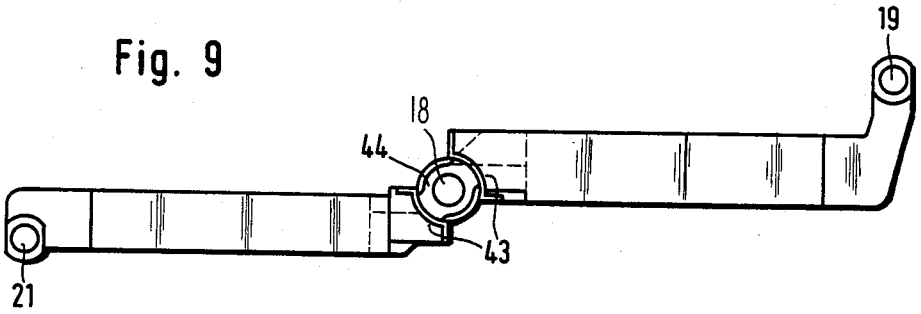
FIG. 9 is the view along the line IX—IX shown in FIG. 8.
Figure 8:
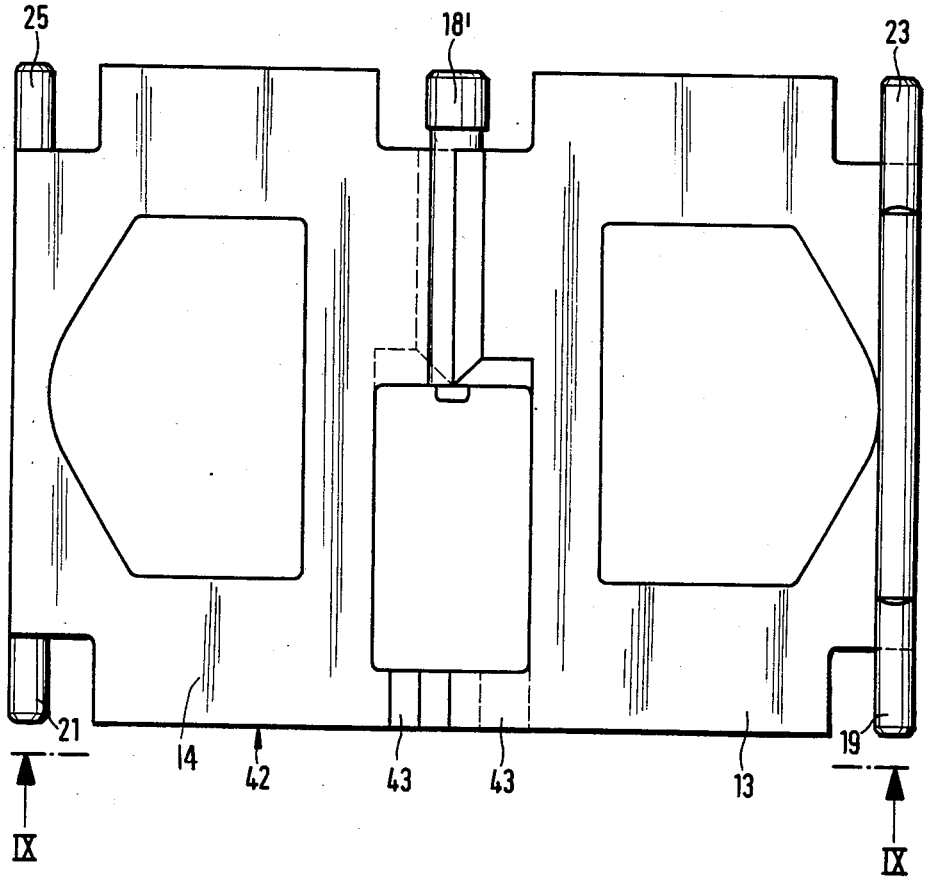
FIG. 8 is the top view of a frame part of the double shears utilized in the key of this invention.

The double shears 11, 12 are formed by two identical frame parts. One of the frame parts 42 is shown in FIGS. 8 and 9. The frame part 42 forms the arms 13 and 14. The pins 19, 21 and 23, 25 are formed on it accordingly. An axle pin 18' is provided on it accordingly near the arm 15. The center of the arm 13 is interrupted in the vicinity of the axis (extension of pin 18'), and it ends there in two fingers 43, which form a bearing shell 44 with a diameter equalling the diameter of the axle pin 18'. To mount the double shears 11, 12, a frame part identical with the frame part 42 is snapped into it rotated by 180°. The fingers 43 of the frame part 42 now encompass the axle pin 17' of the other frame part, whereas the fingers of the latter surround the axle pin 18'. The double shears 11, 12 are thus made of only two components, and the axes 17 and 18 are aligned at the same time and they are forced to move together.

The mode of operation of the key described is approximately the following:

When the key top 10 is pressed in a corner area in the operating direction B, the pin that is located closest to the point at which the pressure is applied seeks to move downward. The corresponding arm is swung, whereby its axis, e.g., 17, moves downward. This causes the other arm to swing in the opposite direction, and the corresponding other pin is consequently carried by it. In addition, the other axis, e.g., 18, is also moved downward, so that the two other arms are swung out as well. As a result, all four upper pins 19, 20, 23 and 24 consequently move uniformly downward, so that the mobile key part 2 moves downward parallel to the mounting plate 4 regardless of the point at which the pressure is applied. Jamming in the guides 29, 40; 31 and 35 is consequently not to be feared. Due to the uniform downward movement of the pins 19, 20, 23 and 24 the switching slide 33 of the support 9 moves uniformly together with the said support toward the switching body 6 regardless of the point at which the pressure is applied. Reliable switching is thus guaranteed.

When the key top 10 is released, the resetting force of the switching body acts upon the switching slide 33. Even though it is located entirely outside of the center of the key 1, the mobile key part 2 is reset parallel. The resetting movement acts primarily on the finger 19. Its arm 13 carries, however, the arm 14 via the axis 17 as well as the axis 18, and thus the arms 15 and 16 as well.

The double shears 11, 12, illustrated in FIGS. 8 and 9, are preferrably made of plastic but can also be made of wire or other equivalent materials.

We claim:

1. A keyboard key having a mobile key part with a touch surface, an immobile key part and an electrical contact positioned within said immobile key part, said surface being large compared with said electrical contact, said surface having a larger portion displace from said electrical contact and a smaller portion over said electrical contact, guiding means for guiding said mobile key part relative to said immobile key part, said guiding means being linked respectively to said mobile key part and to said immobile key part, said guiding means transmitting an operating force exercised on an edge zone of said touch surface onto an opposite edge zone of said mobile key part, characterized in that said guiding means is formed by two shears having two arms each; said arms being connected to pivot on two axes maintained aligned flush with each other, said arms having top ends maintained on four respective support points of said mobile key part in the operating direction and movable across this direction, wherein said four support points define an area which is congruent with said larger portion of said touch surface, and said shear arms having lower free arms held at said immobile key part in the operating direction and movable across this direction.

2. The keyboard key according to claim 1, characterized in that a catch assembly is provided between said mobile key part and said immobile key part.

3. The keyboard key in accordance with claim 1, characterized in that each of said arm ends terminates in a pin, and said mobile key part comprises four guide pockets which respectively guide each of said pins to move relative to said surface only in a direction parallel to said surface.

4. The keyboard key in accordance with claim 1 or 3, wherein said larger surface portion is substantially rectangular and said four support points define a rectangle.

5. The keyboard key in accordance with claim 1, characterized in that said shears are composed of two identical frame parts.

6. The keyboard key in accordance with claim 5, characterized in that said shears carry means for providing a double support joint.

7. The keyboard key in accordance with claim 1, wherein said arms have bottom ends having two pins each, the pins of each bottom end being separated and extending in opposite directions from each other.

8. The keyboard key in accordance with claim 7, further characterized by four guide pockets which respectively guide the movement of each of said bottom end pins.

9. The keyboard key in accordance with claim 1, characterized in that said shear arms are comprised of two frames, each frame having two of said arms.

10. The keyboard key in accordance with claim 9, characterized in that each frame pivots about one of said axes and carries fingers, and the axis of each of said frames is gripped by fingers of the other frame.

11. The keyboard key in accordance with claim 1 or 9, characterized in that said axes are provided centrally on said arms.

12. The keyboard key in accordance with claim 9, characterized in that said mobile key part is composed of a support and a key top positioned over said support.

13. The keyboard key in accordance with claim 12, characterized in that a switching slide for actuating said electrical contact is provided on said support.

14. The keyboard key in accordance with claim 13 characterized in that a guide sleeve (29) for a bolt (40) of the key top (10) is provided on the immobile key part (3).

15. The keyboard key in accordance with claim 12, 13 or 14, characterized in that guide beads (31) for a bead (35) of the support (9) are provided on said immobile key part (3).

16. The keyboard key in accordance with claim 13 characterized in that said switching slide (33) is located outside the center of said touch surface.

17. The support key in accordance with claim 14, characterized in that stops (30, 37) for catch tongues (34, 36) of said support (9) are provided outside on the guide sleeve (20) and on said guide beads (31).

* * * * *